US006124777A

United States Patent [19]

Snider

[11] Patent Number: 6,124,777

[45] Date of Patent: Sep. 26, 2000

[54] CIRCULAR MAGNET TOOL WITH ALIGNMENT INSERT ELEMENT AND METHOD OF ASSEMBLY

[75] Inventor: Greg S. Snider, Medina, Ohio

[73] Assignee: Sulo Enterprises, Inc.

[21] Appl. No.: 09/325,606

[22] Filed: Jun. 3, 1999

[51] Int. Cl.[7] ..... H01F 7/20

[52] U.S. Cl. ..... 335/285; 335/302; 294/65.5

[58] Field of Search ..... 335/285–287, 335/296–298, 302, 304, 305, 306; 24/303; 294/65.5

[56] References Cited

U.S. PATENT DOCUMENTS 2,816,790 12/1957 Johnson ..... 335/285

*Primary Examiner*—Michael L. Gellner
*Assistant Examiner*—Raymond Barrera
*Attorney, Agent, or Firm*—Arter & Hadden LLP

[57] ABSTRACT

A magnet tool and method of assembly, utilizes an alignment insert in a central opening of the magnet to coaxially align fastener guide holes through polar plates or protective covers on opposing planar sides of the magnet and a fastener guide hole in the insert, whereby insertion of the fastener through the guide holes laterally aligns the components of the assembly without the use of adhesive. A method of assembly of the tool without the use of adhesive is also described.

11 Claims, 2 Drawing Sheets

CIRCULAR MAGNET TOOL WITH ALIGNMENT INSERT ELEMENT AND METHOD OF ASSEMBLY

FIELD OF THE INVENTION

The present invention pertains generally to tool assemblies and, more particularly, to the construction and assembly of magnetic tools.

BACKGROUND OF THE INVENTION

Magnet hand tools, such as ferrous object pickup tool and magnetic sweepers, are widely used for commercial and other applications. One popular form of a magnetic hand tool has a magnetic head which is generally disk shaped, made with speaker magnets in the form of generally circular rings. Ferrous steel plates are placed on opposite sides of the disk to create the north an south poles of the magnet. The magnetic flux is concentrated in the two plates. The central hole in the ring-shaped is relatively large, e.g. approximately one third the size of the outer diameter of the magnet. The circular ring shaped magnet is held between upper and lower steel plates, by which the magnet is polarized across the width of the ring between the opposite planar sides. The plates are configured to match the outer perimeter of the ring magnet, so that the magnet is completely sandwiched between the plates. To assemble the tool, this requires that the radial edges of the upper and lower plates be nearly perfectly aligned with the outer perimeter of the magnet and permanently held in this position. In the prior art, the alignment is done by hand. A rivet or other fastener is passed through the plates and through hole in the magnet to keep the assembly tightly stacked together. Because the hole in the magnet is larger than the diameter of the fastener, an adhesive, applied between the plates and the magnet, is relied upon to keep the magnet in lateral alignment with the plates. The use of adhesive is very disadvantageous in the assembly of the tool, because the adhesive must be applied prior to fitting the plates to the magnet. The strong attraction of the plates to the magnet causes the plates to forcefully snap against the magnet, squeezing excess adhesive out of the plate/magnet interface and creating a mess on the exterior perimeter of the assembly. It is not practical to slide the plates into position over the magnet because the plates will effectively scape any adhesive off. Also, once the adhesive degrades, whether from age or exposure to solvents, there is no back-up means in place to retain lateral alignment of the magnet with the plates.

Although magnetic tools of this type can be assembled prior to magnetizing the magnet in a magnetizer, this approach is disadvantageous for the reason that the assembled tools must then be individually magnetized, or a very large magnetizer is required which will accept multiple tools. Also, the steel plates assembled close against the magnet block the magnetic field of the magnetizer from reaching the magnet. With the steel plates attached to the magnet, saturation of the sandwiched magnet within a magnetizer is reduced, especially when multiple magnet/plate assemblies are placed together in a magnetizer. As shown in FIG. 4A, in a stack or array of magnets, with each magnet being sandwiched between steel plates, the magnetic field of a magnetizer is blocked from saturating the magnets, particularly those in the middle of the array between the north and south poles of the magnetizer. Thus magnetizing the bare magnet ceramic prior to assembly is preferred.

SUMMARY OF THE INVENTION

The present invention overcomes these and other disadvantages of the prior art, by providing a circular magnetic tool which can be quickly assembled, and which is held in alignment without the use of adhesives. The magnetic tool assembly includes an alignment insert element which permanently aligns the donut-shaped magnet with upper and lower plates, eliminating the need for adhesive. In accordance with one general aspect of the invention, there is provided a generally circular magnet tool assembly having upper and lower generally circular plates on respective opposite planar sides of a circular generally disk-shaped magnet, the magnet having a control opening larger than an outer diameter of a fastener which passes through the upper and lower plates and the magnet, and an alignment insert element positioned in the central opening in the magnet, an outer dimension of the insert dimensioned to occupy substantially all of the central opening of the magnet, and a through-hole in the insert dimensioned to allow passage of the fastener through the insert.

And in accordance with another aspect of the invention, there is provided a method of assembly of a generally circular magnet tool having a generally circular disk-shaped magnet with an opening through the center of the magnet, an upper plate positioned relative to an upper planar purpose of the magnet, and a lower plate positioned relative to a lower planar surface of the magnet, the plates hold in contact with the respective surfaces of the magnet by a fastener which passes through the plates and through the opening in the magnet, and through an alignment insert element positioned within the opening in the magnet, the alignment insert element having an outer perimeter sized to fit closely within the opening in the magnet, whereby the magnet and the plates are coaxially aligned so that the outer perimeter of the magnet is substantially aligned with the outer perimeters of the plates, the method of assembly including the steps of:

(1) providing a generally circular disk-shaped magnet having an opening which passes through the magnet from an upper planar surface to a parallel lower planar surface, (2) inserting an alignment element in the opening in the magnet so that a perimeter of the alignment element extends to an inner dimension of the opening in the magnet, and so that a fastener hole in the alignment element is substantially axially aligned with the opening in the magnet;

(3) positioning an upper plate substantially flush against the upper surface of the magnet and aligning a perimeter of the upper plate with a perimeter of the magnet;

(4) positioning a lower plate substantially flush against the lower surface of the magnet and aligning a perimeter of the lower plate with a perimeter of the magnet, and (5) inserting a fastener through coaxially aligned holes in the upper and lower plates and the alignment element, whereby the plates and magnet are held in coaxial alignment by the alignment insert.

In another general aspect of the invention, a method a manufacturing and assembly of magnetic tools is described wherein a plurality of magnets are magnetized prior to assembly, and thereafter assembled in a magnetic tool wherein magnet support plates are slid into contact with generally planar surfaces of the magnet and held in place without adhesive. The magnets can be magnetized in an array of ten or more at a time, with or without a non-ferrous alignment insert in position within the center of the magnet.

These and other aspects of the invention are herein described in detail with reference to the accompanying Figures.

DETAILED DESCRIPTION OF THE INVENTION

Figure 1:
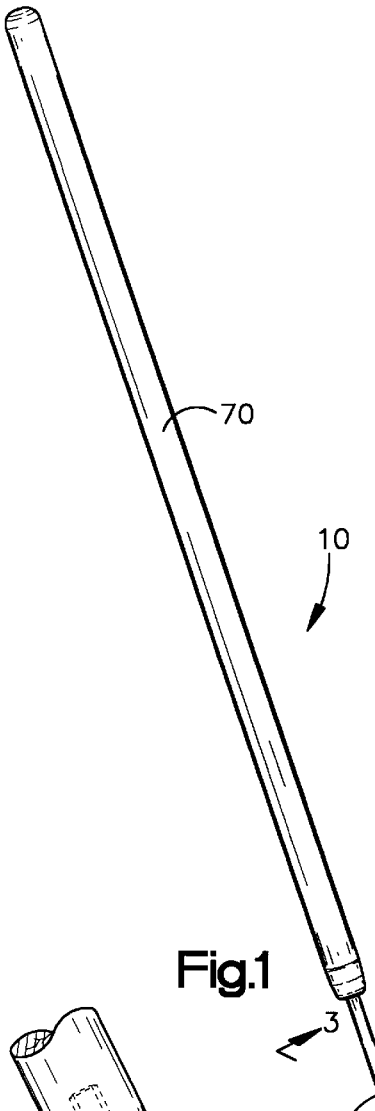
FIG. 1 is a perspective view of one embodiment of a magnet tool constructed in accordance with the present invention.
Figure 2:
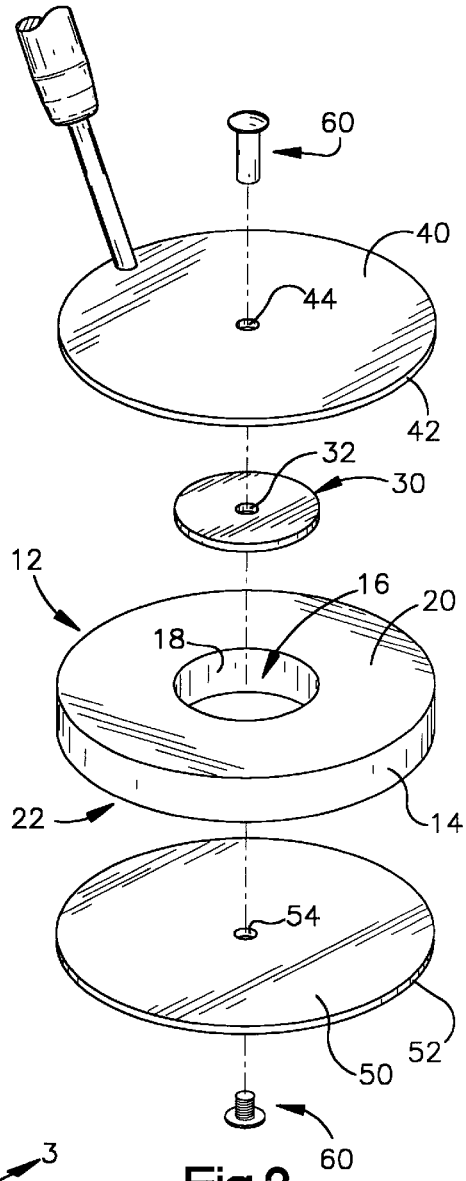
FIG. 2 is an exploded perspective view of the magnet tool of FIG. 1.
Figure 3:
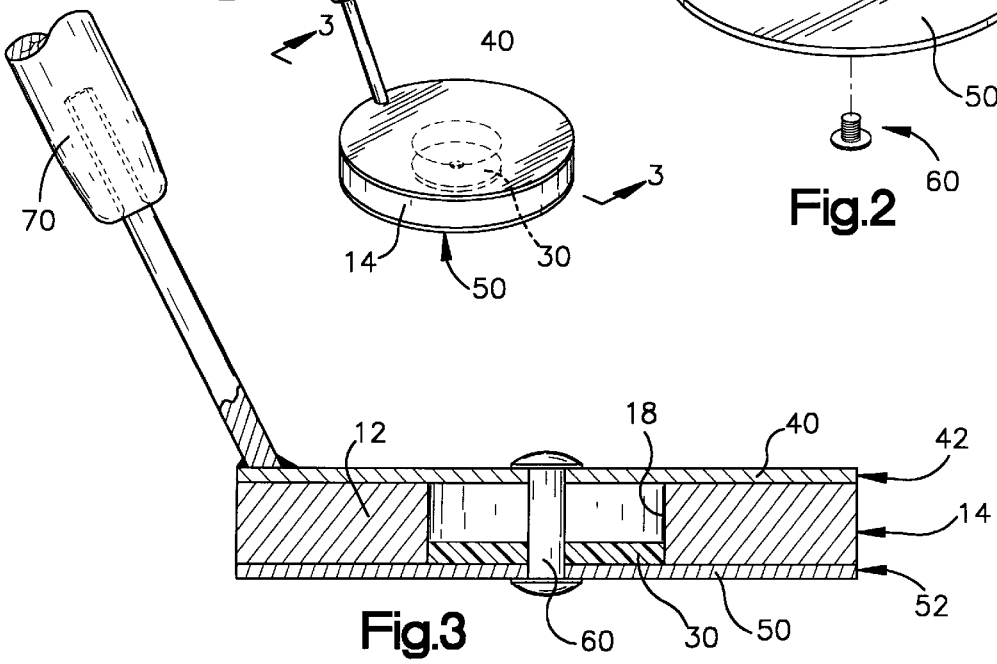
FIG. 3 is a cross-sectional view of the magnet tool of FIG. 1.

As shown in the Figures, the invention is a magnet tool assembly, indicated generally at 10, which includes a generally circular disk-shaped magnet 12. In this embodiment the magnet 12 is ring-shaped, with an annular perimeter 14 at the outer diameter or dimension of the magnet, and an opening or through-hole 16, with a perimeter 18 located at an inner diameter or dimension. The magnet 12 has an upper planar surface 20, and a parallel lower planar surface 22. Although referred to as "upper" and "lower", the description and invention is not limited to any particular orientation of these surfaces or components.

An alignment insert 30 has a generally circular shape dimensioned to fit within the opening 16 of the magnet 12, with the insert oriented in a plane parallel with the upper and lower surfaces of the magnet 12, and with an outer diameter or dimension which fits closely within the opening 16. The insert 30 is made of a non-ferrous material which does not interact with the poles flux of the magnet 12. The thickness of the insert 30 is preferably less than the thickness of the magnet 12. The insert further includes a fastener guide hole 32 which is generally coaxially aligned with the opening 16 in the magnet 12.

An upper plate 40 has a perimeter 42 which is dimensioned preferably closely similar to the perimeter 14 of the magnet 12, and a centrally disposed fastener guide hole 44 which is generally coaxially aligned with the guide hole 32 of the alignment insert 30 when the perimeter 42 of the upper plate 40 is generally aligned with the perimeter 14 of the magnet 12.

A lower plate 50 is configured similarly to the upper plate 40, and positioned flush against the lower surface 22 of the magnet, with the perimeter 52 and fastener guide hole 54 similarly aligned. The fastener 60, such as a rivet or other suitable device, is passed through the respective guide holes of the parts and through the opening 16 of the magnet 12, whereby the assembly of the upper and lower plates 40 and 50 and the magnet 12 are held tightly together and in vertical alignment. As further shown in the Figures, a handle 70 may be attached to one of the plates for manipulation of the magnet tool assembly.

In a related method of assembly of the magnet tool, the alignment insert 30 is placed within the opening 16 of the magnet 12 prior to positioning of the plates 40 and 50 on the opposing planar surfaces of the magnet. Because the outer diameter of the magnet is substantially equal to the inner dimension or diameter of the opening 16, the insert is generally oriented parallel with the upper and lower surfaces 20 and 22 of the magnet, with the fastener guide hole 32 of the insert 30 generally coaxially aligned with the center axis of the opening 16. Therefore, when the perimeters of the upper and lower plates 40 and 50 are aligned with the perimeter of the magnet, the guide holes 44 and 54 are aligned with the guide hole 16 of the insert 12, and the fastener 60 can be easily inserted through the assembly. The assembly process is very quick and does not require the use of any adhesive or preparation of parts prior to assembly.

Figure 4A:
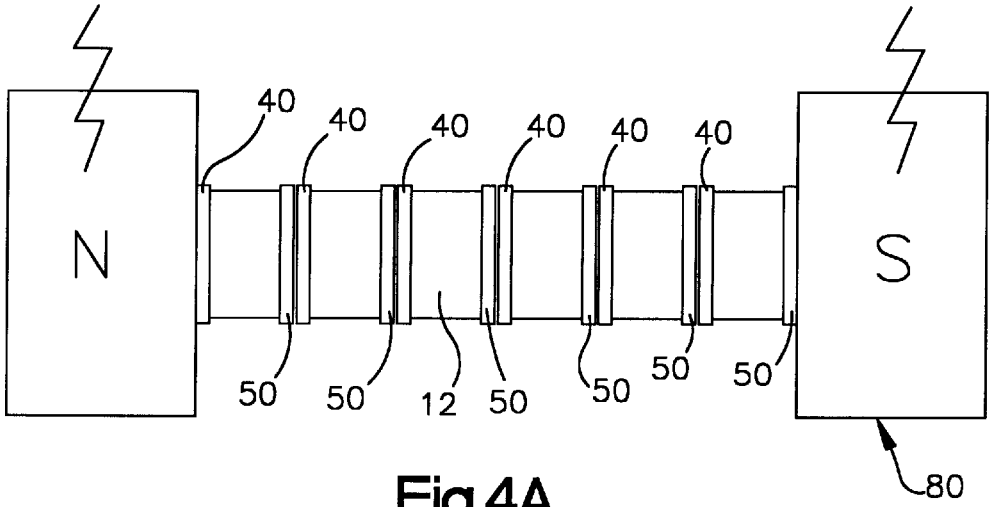
FIG. 4A is a schematic view of a plurality of assembled magnet tools in a magnetizer.
Figure 4B:
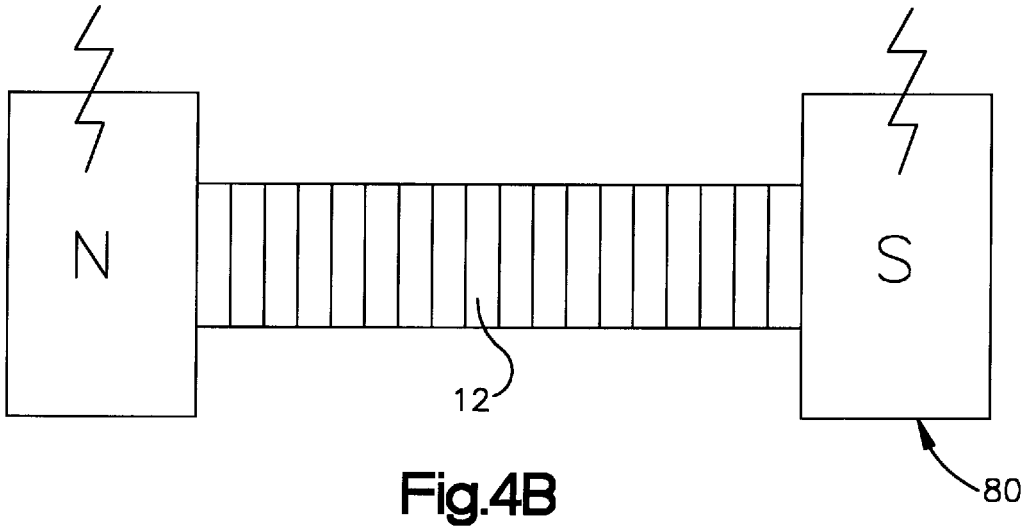
FIG. 4B is a schematic view of a plurality of unassembled magnets in a magnetizer.

It is preferred in the above described method that the magnet be magnetized prior to assembly, wherein there are no other parts which interfere with the magnetization process. Even more preferably, a plurality of magnets 12 are magnetized together between poles of a magnetizer 80, as shown in FIG. 4B, and are then ready for assembly. The plates 40 and 50 are preferably put into position against the planar surfaces of the magnet by sliding over the magnet surfaces, to avoid the snapping action which occurs when the plates brought into direct and immediate contact with the magnet.

Although the invention has been described with reference to a particular embodiment, it will be appreciated that the invention is not limited to magnet tool assemblies of this exact shape or configuration, and that in fact the invention pertains to any type of magnet tool assembly wherein alignment of a magnet having an internal cavity or opening or through-hole with outer protective coverings is required.

What is claimed as the invention is:

1. A magnet tool assembly having upper and lower generally circular plates on respective opposite planar sides of a generally circular disk-shaped magnet, the magnet and plates having substantially equal diameters and wherein circumferential edges of the magnet and plates are to be aligned, the magnet having a central opening larger than an outer diameter of a fastener which passes through center openings in the upper and lower plates and the magnet, and an alignment insert element positioned in the central opening in the magnet, an outer dimension of the insert dimensioned to occupy substantially all of the central opening of the magnet, and a through-hole in the radial center of the alignment insert dimensioned to allow passage of the fastener through the insert, whereby the circumferential edges of the magnet and plates are aligned by the alignment insert in the central opening in the magnet and the fastener in the center openings of the plates and the through-hole in the alignment insert.

2. The magnet tool assembly of claim 1 further comprising a circular plate on each of the two opposed planar sides of the magnet, the plates having a circumferential perimeter aligned with a circumferential perimeter of the magnet when axially aligned with the magnet, fastener guide holes through the plates through which a fastener is inserted to pass through the plates and the central opening of the magnet, whereby the plates are held against the planar sides of the magnet and perimeter alignment with the magnet.

3. The magnet tool assembly of claim 1 wherein the central opening in the magnet is generally circular, and an outer configuration of the alignment insert is generally circular and dimensioned to fit closely within the central opening of the magnet, and wherein the alignment insert is generally planar and oriented generally parallel to planar surfaces of the magnet when in the central opening of the magnet, with a fastener guide hole in the alignment insert generally coaxially aligned with the central opening of the magnet.

4. The magnet tool assembly of claim 1 wherein the alignment insert is constructed of a non-ferrous, non-magnetic material.

5. The magnet tool assembly of claim 1 wherein an outer perimeter of the assembly is generally circular.

6. A method of assembly of a generally circular magnet tool having a generally circular disk-shaped magnet with an opening through the center of the magnet, an upper circular plate having a smooth radial edge and approximate same diameter as the magnet positioned relative to an upper planar surface of the magnet, and a lower circular plate having a smooth radial edge and approximate same diameter as the magnet positioned relative to a lower planar surface of the magnet, the plates held in contact with the respective surfaces of the magnet by a fastener which passes through the plates and through the opening in the magnet, the alignment insert element having an outer perimeter sized to fit closely within the opening in the magnet, whereby the magnet and the plates are coaxially aligned so that the outer perimeter of the magnet is aligned with the outer perimeters of the plates, the method of assembly including the steps of:

(1) providing a generally circular disk-shaped magnet having an opening which passes through the magnet from an upper planar surface to a parallel lower planar surface, (2) inserting an alignment element in the opening in the magnet so that a perimeter of the alignment element extends to an inner dimension of the opening in the magnet, and so that a fastener hole in the alignment element is substantially axially aligned with the opening in the magnet;

(3) positioning an upper circular plat substantially flush against the upper surface of the magnet and aligning a perimeter of the upper circular plate with a perimeter of the magnet;

(4) positioning a lower circular plate substantially flush against the lower surface of the magnet and aligning a perimeter of the lower circular plate with a perimeter of the magnet, and (5) inserting a fastener through coaxially aligned holes in the upper and lower plates and alignment element, whereby the plates and magnet are held in coaxial alignment with circular edges of the magnet and plates aligned by the alignment insert, and the fastener in the aligned holes in the upper and lower plates and alignment insert.

7. The method of claim 6 wherein the upper and lower plates are positioned against the respective surfaces of the magnet by sliding the plates over the respective surfaces of the magnet.

8. The method of claim 6 further comprising the step of magnetizing the magnet prior to assembly of the tool.

9. The method of claim 6 further comprising the step of magnetizing the magnet within a stack of a plurality of magnets prior to assembly of the tool.

10. The method of claim 6 wherein the upper and lower plates are positioned against the respective surfaces of the magnet by sliding over the respective surfaces of the magnet.

11. A magnet tool assembled by the process of:

a) magnetizing a magnet among a plurality of magnet ceramics positioned in an array between poles of a magnetizer, b) positioning an alignment insert with a fastener guide hole in a central opening of the magnet, c) positioning the magnet between circular upper and lower plates having substantially the same diameter and circumference as the magnet by positioning the plates adjacent upper and lower respective surfaces of the magnet by sliding the plates over the respective surfaces of the magnet and aligning the circumferential edges of the plates and the magnet by sliding adjustment of the plates on the magnet surfaces, and d) fastening the plates relative to the magnet by inserting a fastener through fastener guide holes in the plates and through the fastener guide hole in the alignment insert.

* * * * *